US008485815B2

(12) United States Patent
Witting et al.

(10) Patent No.: US 8,485,815 B2
(45) Date of Patent: Jul. 16, 2013

(54) OVERHUNG ROTARY TUBE FURNACE

(75) Inventors: Peter R. Witting, West Seneca, NY (US); William J. Stry, Orchard Park, NY (US); Carl H Vander Weide, Lockport, NY (US); Jeffrey E. Purdy, Alden, NY (US); Jason A. Ginn, Corfu, NY (US)

(73) Assignee: Harper International Corporation, Lancaster, NY (US)

( * ) Notice: Subject to any disclaimer, the term of this patent is extended or adjusted under 35 U.S.C. 154(b) by 1074 days.

(21) Appl. No.: 12/387,784

(22) Filed: May 7, 2009

(65) Prior Publication Data

US 2009/0286193 A1 Nov. 19, 2009

Related U.S. Application Data

(60) Provisional application No. 61/127,423, filed on May 13, 2008.

(51) Int. Cl.
*F27B 7/14* (2006.01)

(52) U.S. Cl.
USPC ..... 432/118; 432/87; 432/245; 432/152; 219/634; 219/411

(58) Field of Classification Search
USPC ..... 432/118, 87, 245, 152, 253, 6, 206, 432/114, 103, 105, 239; 219/634, 411; 118/666; 110/246
See application file for complete search history.

(56) References Cited

U.S. PATENT DOCUMENTS

| | | | | |
|---|---|---|---|---|
| 2,739,801 | A * | 3/1956 | Rankin | 432/113 |
| 3,836,324 | A * | 9/1974 | Shaefer et al. | 432/112 |
| 4,025,297 | A * | 5/1977 | Smith et al. | 432/112 |
| 4,071,229 | A * | 1/1978 | Domazer et al. | 266/173 |
| 4,802,441 | A * | 2/1989 | Waugh | 118/666 |
| 5,000,682 | A * | 3/1991 | Heidt et al. | 432/241 |
| 5,083,864 | A * | 1/1992 | Huetsch et al. | 356/312 |
| 5,256,060 | A * | 10/1993 | Philipossian et al. | 432/152 |
| 5,746,590 | A * | 5/1998 | May et al. | 432/114 |
| 6,042,370 | A | 3/2000 | Vander Weide | |
| 6,312,626 | B1 * | 11/2001 | Mitchell et al. | 264/5 |
| 6,575,739 | B1 * | 6/2003 | Yoo | 432/239 |
| 2004/0112176 | A1 * | 6/2004 | Khan et al. | 75/369 |
| 2008/0308970 | A1 | 12/2008 | Jonczyk et al. | |

FOREIGN PATENT DOCUMENTS

| | | | |
|---|---|---|---|
| JP | 10-089849 | A | 4/1998 |
| JP | 2001-050670 | A | 2/2001 |
| JP | 2001099573 | A | 4/2001 |
| JP | 2001-280851 | A | 10/2001 |

* cited by examiner

*Primary Examiner* — Avinash Savani

(74) *Attorney, Agent, or Firm* — Phillips Lytle LLP

(57) ABSTRACT

A rotary tube furnace (1) comprising an insulated heating chamber (4), the insulated heating chamber having a product discharge outlet (21) and a process tube inlet (39), a heating element (14) operatively arranged to selectively heat the heating chamber, a generally horizontally extending process tube (2) supported for rotation relative to the heating chamber, the process tube having a first portion (36) generally arranged outside of the heating chamber and a cantilevered second portion (37) extending from the first portion into the heating chamber and terminating at a discharge end (38) within the heating chamber, a feed mechanism (40) configured and arranged to feed product into the process tube, and a bearing assembly operating between a support frame (34) and the first portion of the process tube and configured and arranged to support the process tube and transmit rotational torque to the process tube.

39 Claims, 6 Drawing Sheets

OVERHUNG ROTARY TUBE FURNACE

CROSS-REFERENCE TO RELATED APPLICATIONS

This application claims the benefit of U.S. Provisional Patent Application No. 61/127,423, filed May 13, 2008. The entire content of such application is incorporated by reference herein.

TECHNICAL FIELD

The present invention relates to rotary tube furnaces for high temperature treatment of various materials and, more particularly, to an overhung rotary tube furnace.

BACKGROUND ART

Rotary tube furnaces within direct heating are commonly used for physical and chemical conversions of both solids and powders. U.S. Pat. No. 6,042,370 discloses a furnace having a graphite tube inside an oxygen free chamber with graphite heating elements capable of heating to temperatures as high as 2800° C. It is known that graphite may be used as one of the construction materials in such furnaces. It is also known that furnaces operating at extreme temperatures frequently require that the treatment of the material being processed be carried out in an inert atmosphere, such as a non-oxidizing atmosphere, to avoid undesired reactions. In addition, when graphite is used as part of the furnace, it may also react with the oxygen and air at extremely high temperatures. Thus, it is known to provide an inert atmosphere enveloping the graphite furnace equipment as well as the material being processed.

DISCLOSURE OF THE INVENTION

With parenthetical reference to corresponding parts, portions or surfaces of the disclosed embodiment, merely for the purposes of illustration and not by way of limitation, the present invention provides a rotary tube furnace (1) comprising an insulated heating chamber (4), the insulated heating chamber having a product discharge outlet (21) and a process tube inlet (39), a heating element (14) operatively arranged to selectively heat the heating chamber, a generally horizontally extending process tube (2) supported for rotation relative to the heating chamber, the process tube having a first portion (36) generally arranged outside of the heating chamber and a cantilevered second portion (37) extending from the first portion into the heating chamber and terminating at a discharge end (38) within the heating chamber, a feed mechanism (40) configured and arranged to feed product into the process tube, and a bearing assembly operating between a support frame (34) and the first portion of the process tube and configured and arranged to support the process tube and transmit rotational torque to the process tube.

The heating chamber may comprise an outer shell (10), a heat conductive muffle (15), and an insulation layer (11) between the outer shell and the muffle. The heating chamber may comprise a gas inlet (16) and a gas outlet (20) operatively arranged to maintain a selected gas atmosphere around the process tube in the heating chamber. The product discharge outlet may comprise a discharge chute (22) and a discharge heating element (25) operatively arranged to selectively heat the discharge chute. The heating element may be operatively arranged to selectively heat the heating chamber to at least 1200 degrees Celsius and the heating element may be operatively arranged to selectively heat the heating chamber to about 2600 degrees Celsius. The heating element may be a graphite resistance heating element or the heating element may comprise an induction coil (30) and a graphite susceptor (31). The process tube may be graphite or quartz. The process tube may comprise a liner (3) and the liner may be quartz or ceramic. The process tube may comprise two or more tube sections. The feed mechanism may comprise a feeder (7) communicating with a feeder tube (6) that extends into the process tube. The feeder tube may extend through the first portion of the process tube and may terminate at a feed discharge end (42) within the heating chamber. The furnace may further comprise an insulating baffle (13) between the feeder tube and the process tube. The feeder tube may comprise a gas port (17) operatively arranged to selectively provide a co-current or counter-current flow of gas through the process tube. The bearing assembly may comprise a drive motor (35), an inner flexible collar (26) extending around the first portion of the process tube, an outer cylindrical member (5) connected to the collar and the drive motor, and a pair of rollers (9) supporting the cylindrical member, wherein the cylindrical member provides counterbalance to the cantilevered second portion of the process tube. The process tube may be inclined from the discharge end to the first portion.

In another aspect, the invention provides a rotary tube furnace comprising a heating zone (48) comprising an insulated heating chamber having a product discharge outlet and a process tube inlet, a heating element operatively arranged to selectively heat the heating zone, a generally horizontally extending process tube supported for rotation relative to the heating chamber and having an feed entrance end (43) and a product discharge end (38), a feed mechanism configured and arranged to feed product into the process tube, a bearing assembly operating between a support member and the process tube and configured and arranged to support the process tube and transmit rotational torque to the process tube, and the process tube and the bearing assembly configured and arranged such that the product discharge end is within the heating zone.

In another aspect the invention provides a rotary tube furnace comprising an insulated heating chamber, the insulated heating chamber having a product discharge outlet and a process tube inlet, a heating element operatively arranged to selectively heat the heating chamber, a generally horizontally extending process tube supported for rotation relative to the heating chamber and having a feed entrance end portion and a product discharge end portion, a feed mechanism configured and arranged to feed product into the process tube, the feed mechanism comprising a feeder communicating with a feeder tube that extends through the process tube inlet of the heating chamber, the feeder tube comprising an end portion that extends into the heating chamber and terminates within the heating chamber, the feeder tube having a thermal barrier (27) at said end portion, and a bearing assembly operating between a support member and the process tube and configured and arranged to support the process tube and transmit rotational torque to the process tube.

One object is to provide an improved rotary tube furnace that provides the materials being processed without premature melting.

Another object is to provide an improved rotary tube furnace that discharges the materials being processed without premature freezing.

Another object is to provide an improved rotary tube furnace that processes materials at high temperatures without the material adhering to the processing equipment.

Another object is to provide an improved rotary tube furnace where material flow is not blocked by undesired material build-up.

These and other objects and advantages will become apparent from the foregoing and ongoing written specification, the drawings, and the claims.

DESCRIPTION OF PREFERRED EMBODIMENTS

Figure 1:
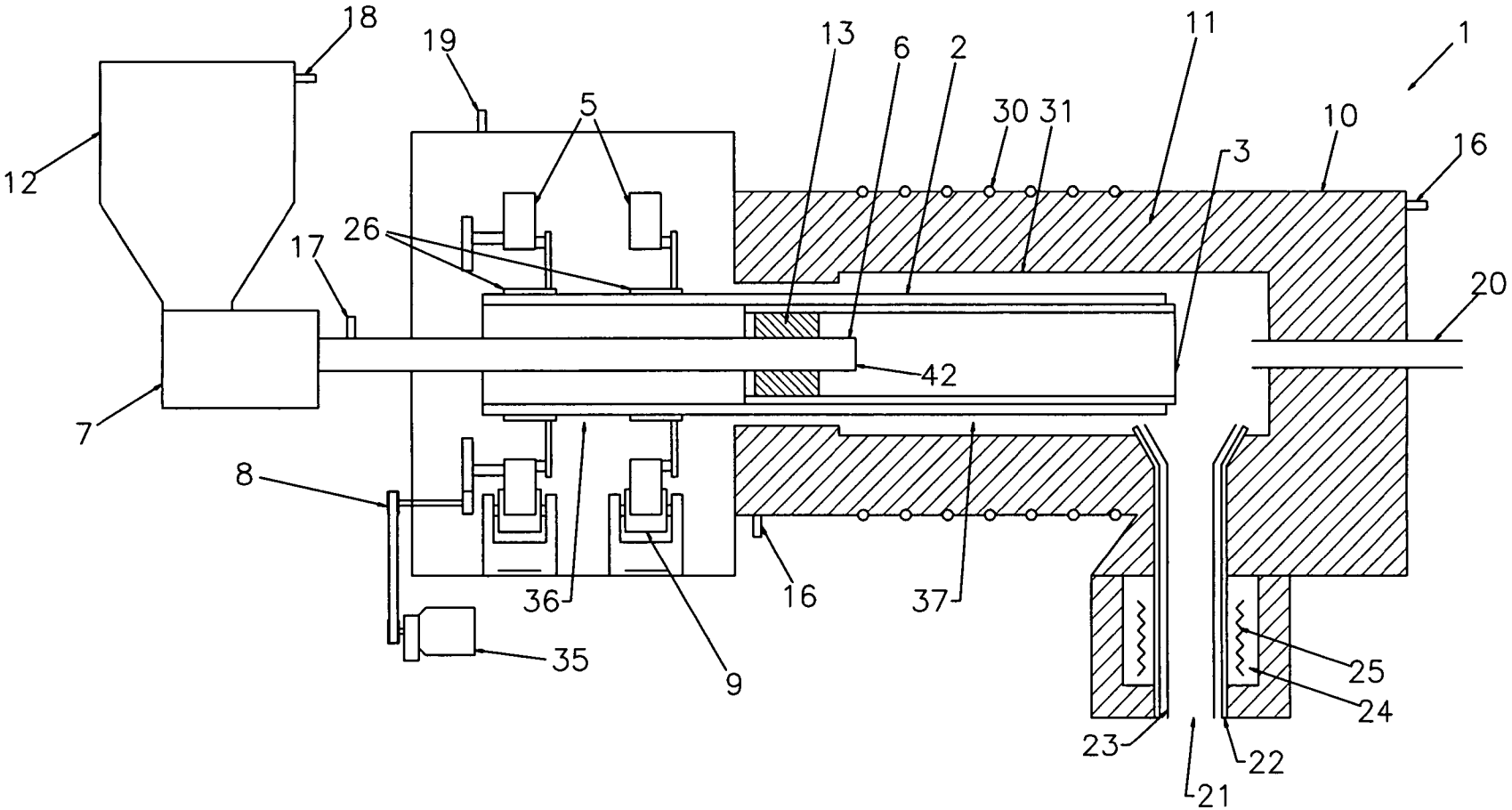
FIG. 1 is sectional view of a first embodiment of the rotary tube furnace of the present invention.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up " and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, and more particularly to FIG. 1 thereof, this invention provides an improved rotary tube furnace, of which a first embodiment is generally indicated at 1. As shown, furnace 1 generally includes an insulated heating chamber 4, a heating element 14 operatively arranged to selectively heat the heating chamber, a horizontally-extending graphite process tube 2 elongated along axis x-x and supported for rotation about axis x-x, a feed mechanism 40 configured and arranged to feed product into process tube 2, and a bearing assembly 41 operating between a support frame 34 and process tube 2 that supports process tube 2 and transmits rotational torque to process tube 2.

Figure 2:
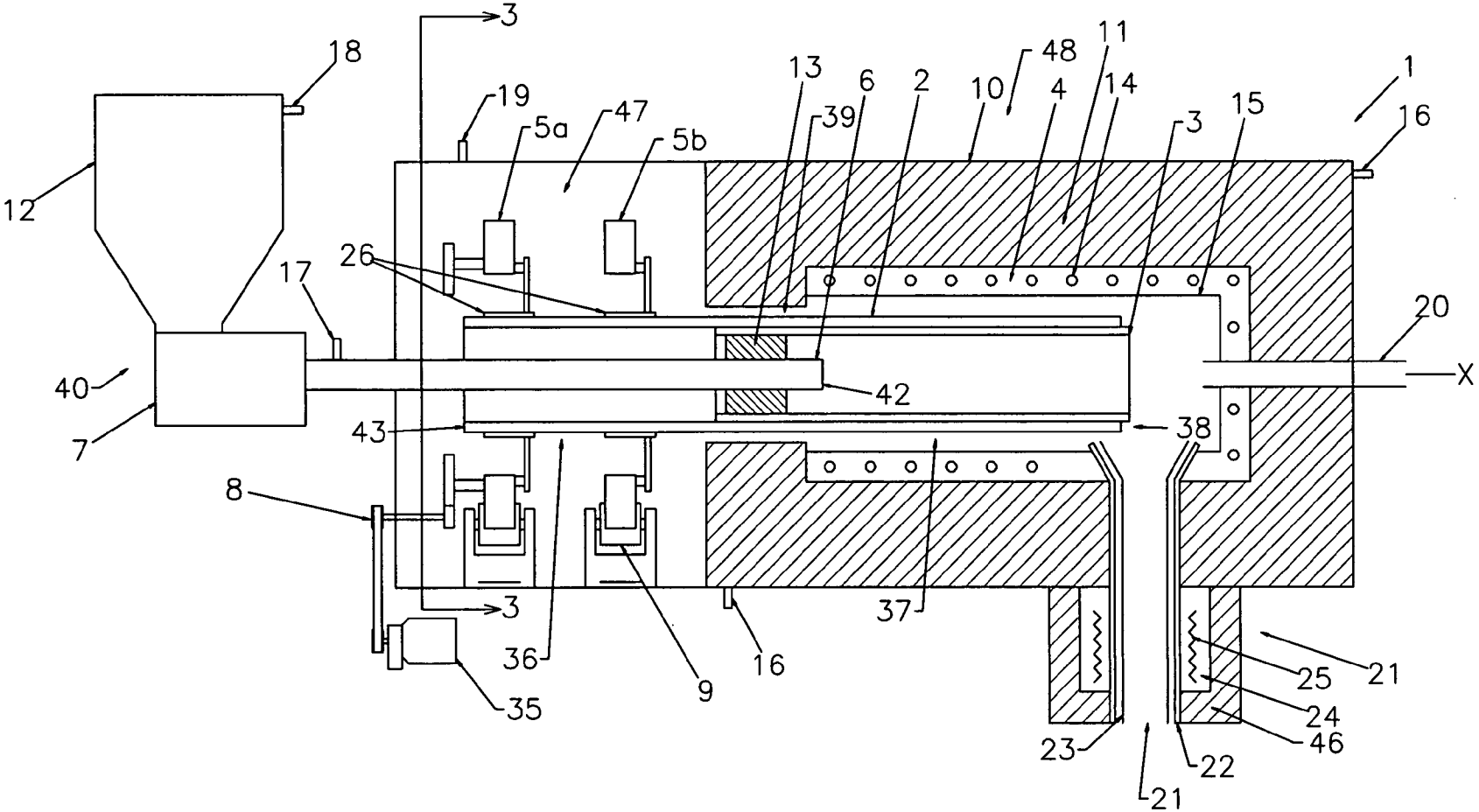
FIG. 2 is a sectional view of an alternative embodiment of the rotary tube furnace shown in FIG. 1.

As shown in FIG. 1, furnace 1 is divided into a heating section 48 and a drive or entrance section 47. Heating section 48 of furnace 1 comprises a heating chamber 4 within an insulation enclosurer 11, which in turn is enclosed in metal shell 10, which may be of a suitable heat resistant material, such as stainless steel. In the preferred embodiment, insulation 11 is high temperature insulation, such as formed carbon fiber or other suitable fibrous insulation. Heating chamber 4 contains one or more conventional heating elements 14 adapted to selectively heat chamber 4. In the embodiment shown in FIG. 1, heating elements 14 are graphite resistance heating elements. However, it is contemplated that other heating methods may be employed. For example, as shown in FIG. 2, graphite tube 2 may be inductively heated using conventional induction coils 30 and graphite susceptor 31. Heating chamber 4 also contains a highly conductive graphite muffle 15, which separates the area in which material is discharged from process tube 2 from heating elements 14. This separation of heating elements 14 and the process area allows heating elements 14 to be purged with clean non-oxidizing gas.

Thermally insulated heating chamber 4 surrounds the portion of tube 2 being heated with at least one zone of control and at least one element per zone of control. However, while furnace 1 is shown as having a single heating zone, heating chamber 4 may be divided into multiple temperature zones separated by insulation barriers to allow for greater temperature definition. Thus, heating elements 14 may be powered and positioned as desired to provide a constant temperature throughout the heating zone or to provide multiple temperature zones for thermal profiling.

Heating chamber 4 includes a number of ports or vents. Material being processed exits the floor of heating chamber 4 through discharge assembly 21. Discharge assembly 21 comprises a chute heating chamber 24 within a chute insulation enclosure 46. Chute heating elements 25 heat chute heating chamber 24. Discharge chute 22 passes through chute heating chamber 25 and is thus separately heated. A liner 23 may be provided in discharge chute 22 to facilitate movement of material being processed. Accordingly, discharge chute 22 is separately heated to prevent melted material exiting process tube 2 from prematurely cooling and sticking to discharge chute 22 or its liner 23. Discharge chute 22 may feed a solidification unit or some other conventional collection device.

Process tube 2 extends into heating chamber 4 through process tube inlet 39. Process tube 2 is generally a cylindrical graphite or quartz member elongated along axis x-x and adapted to rotate about axis x-x. As shown, process tube 2 extends from the entrance or drive section 47 of furnace 1 into heating chamber 4 of the heating section 48 of furnace 1. While shown as extending horizontally, under normal operating conditions process tube 2 is tilted from horizontal to aid the movement of materials through process tube 2. In addition, while process tube 2 is shown as being formed of a single tubular unit, it may be formed from two or more interconnected sections of tube, depending on various considerations, such as the total length required and the specific requirements of each section of the tube. Also, the materials used to form the sections of tube may vary depending on their position in the furnace, with the sections of tube 2 upstream of insulating plug 13 being metal rather than graphite sections. In the preferred embodiment, tube 2 includes an inner liner 3. In the preferred embodiment, liner 3 is a quartz tube. However, it is contemplated that this inner or second tube may be formed of graphite or ceramic, such as silicon carbide, alumina or mullite, depending on considerations such as the materials being processed. Liner 3 may be a second piece of sacrificial graphite.

Figure 5:
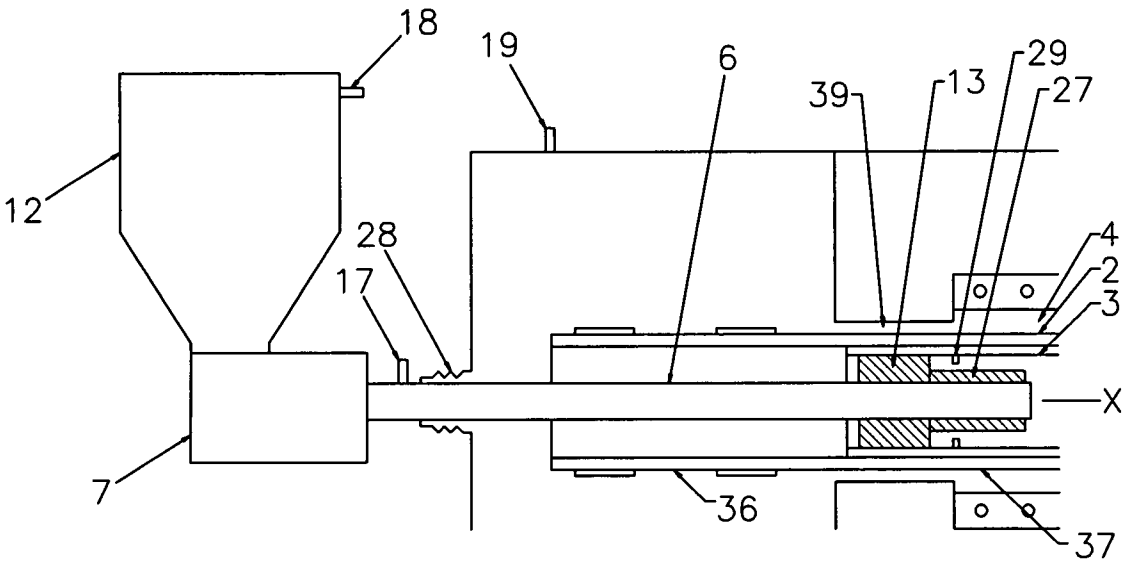
FIG. 5 is a partial sectional view of a third embodiment of the rotary tube furnace shown in FIG. 1.
Figure 6:
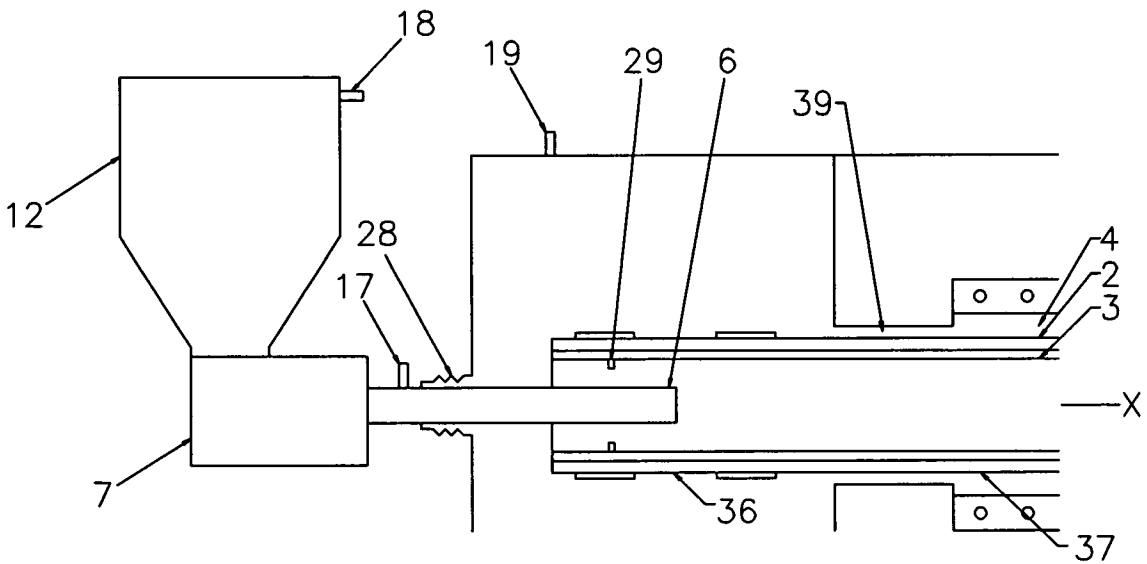
FIG. 6 is a partial sectional view of a fourth embodiment of the rotary tube furnace shown in FIG. 1.

As shown in FIG. 1, feed mechanism 40 is provided to deliver material or product to process tube 2. In the preferred embodiment, feed mechanism 40 comprises a feed hopper 12, a feeder 7 and a feeder tube 6 which terminates at a feed discharge end 42 within process tube 2. Material to be treated by process tube 2 enters hopper 12, where it is then delivered into feeder tube 6 by feeder 7. The material then passes through the remaining portion of process tube 2. In this embodiment, feeder 7 is a screw 45 type feeder and feeder tube 6 includes a liner 44. However, feeder 7 may be vibratory or pneumatic type feeder and, as shown in FIGS. 5 and 6, flexible bellows 28 may be positioned between metal shell 10 and feeder tube 6 so that feeder tube 6 motion, such as vibration, is not hindered and an adequate seal is provided for gas containment purposes. In addition, a dam 29 may be installed in process tube 2 or in liner 3 of process tube 2 to prevent backflow of feed material. Other types of feeders may also be employed. For example, a reciprocating scoop type feeder may be used, in which scoops of material are fed into the hot zone one scoop at a time.

The length of feeder tube 6 may vary as desired. For example, in the embodiment shown in FIG. 6, feeder tube 6 extends into only the first portion 36 of tube 2, terminating well before portion 37 of process tube 2 and inlet 39 to heating chamber 4. In this embodiment, an insulating baffle 13 is not employed. Alternatively, as shown in FIGS. 1 and 2, feeder tube 6 may extend into portion 37 of process tube 2 and terminate just beyond inlet 39 of heating chamber 4. In this embodiment, an insulating baffle 13 is provided between the outer cylindrical surface of feeder tube 6 and the inner cylindrical surface of liner 3 in process tube 2. In yet another embodiment shown in FIG. 5, feeder tube 6 extends further into heating chamber 4 than the embodiment shown in FIGS. 1 and 2. In this embodiment, a feed tube thermal barrier 27 is provided for the portion of feeder tube 6 that extends into heating chamber 4 beyond inlet 39 to limit the heating of the material being fed through feeder tube 6. Thus, in this embodiment material may be fed directly into the heated part of process tube 2.

As shown, process tube 2 is supported from its entrance end and has a cantilevered portion 37 that extends freely through inlet 39 into heating chamber 4. Thus, heating tube 2 has a first portion 36 generally arranged outside of heating chamber 4 and a cantilevered second portion 37 extending from the first portion through inlet 39 into heating chamber 4 and terminating at a discharge end 38 within heating chamber 4. This provides a number of unexpected benefits. With cantilevered tube 2, furnace 1 is suitable for partially melting material in a continuous feed system without causing premature melting. In addition, because the material is discharged from discharge end 38 of tube 2 into the hot zone of the furnace, the material is discharged without premature freezing. With feeder tube 6, the backflow of heat from heating chamber 4 does not melt material being processed, thereby causing it to stick together or to the walls of process tube 2. Likewise, discharging from cantilevered portion 37 in heating chamber 4 reduces the likelihood of material sticking together or to the tube walls or downstream surfaces, thereby blocking material flow.

Figure 3:
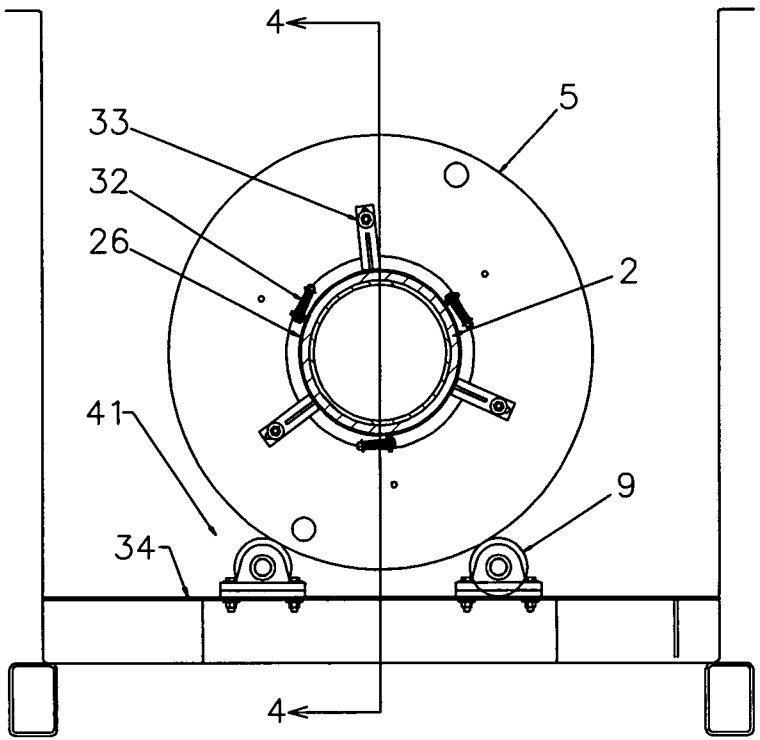
FIG. 3 is a partial transverse vertical sectional view of the embodiment shown in FIG. 1, taken generally on line 3-3 of FIG. 1.
Figure 4:
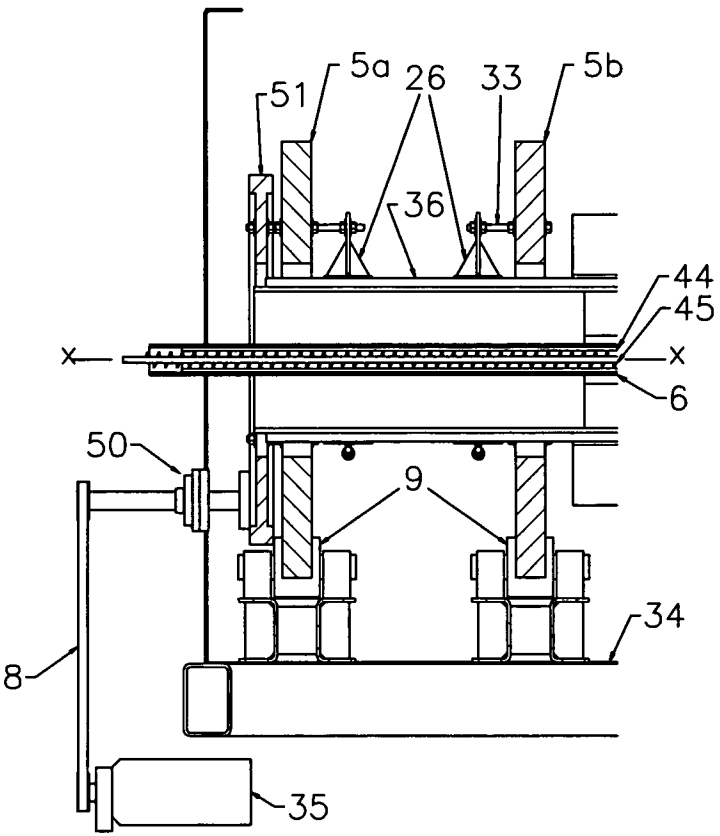
FIG. 4 is a partial longitudinal vertical sectional view of the embodiment shown in FIG. 1, taken generally on line 4-4 of FIG. 3.

As shown in FIGS. 3 and 4, process tube 2 is supported in its cantilevered orientation and rotated with bearing assembly 41. In this embodiment, bearing assembly 41 comprises a motor 35 connected to a sprocket 50 with drive chain assembly 8. Sprocket 50 is in turn connected to metal tire 5*a*. Tires 5 are each connected to process tube 2 with flexible collars 26, which maintain frictional grip on the outer surface of first portion 36 of process tube 2 while taking up any thermal expansion differences between process tube 2 and collar 26. The flexibility in collar 26 is provided by means of multiple springs 32 acting between sections of cylindrical collar 26. In this embodiment, collar 26 is connected to tire 5 by connecting rod 33. Thus, drive motor 35 and assembly 8 rotate sprocket 50 and, in turn, tire 5*a*. Rotation of tire 5*a* about axis x-x causes rotation of collar 26 and, in turn, rotation of process tube 2 about axis x-x.

As shown on FIG. 3, two steel trunnion rollers 9 connected to frame 34 rotationally support each metal tire 5. Tire 5*a* closest to feeder 7 is weighted sufficiently to counter the weight of the overhung or cantilevered portion 37 of tube 2. The weight of tire 5*a* is sufficient not only to counter cantilevered portion 37 of process tube 2, but also any additional weight arising from liner 3 or other equipment on process tube 2. Rollers 9 supporting tire 5*b* are positioned at the fulcrum point between the first portion 36 and the cantilevered portion 37 of process tube 2. The weight of tires 5 and associated connectors is such that the center of gravity of process tube 2 along axis x-x is located between tires 5*a* and 5*b*. Thus, process tube 2 does not tip off the rollers. A locating roller may also be positioned on drive tire 5*a* to help maintain the position of tube 2*a* horizontally along axis x-x. While a twin tire bearing assembly 41 has been described in this embodiment, it is contemplated that other bearing or drive assemblies may be employed.

In operation at high temperatures, it is often preferred to maintain a non-oxidizing atmosphere, such as a nitrogen or argon gas atmosphere, in heating chamber 4 and process tube 2. In this embodiment, entrance 43 of process tube 2 is enclosed in, or surrounded by, a chamber for the containment of atmosphere, dust and light. Heating chamber 4, this entrance chamber, and discharge assembly 21 form an enclosure to maintain the selected atmosphere around and within process tube 2. The interior atmosphere of process tube 2 may be controlled by passing a non-oxidizing gas, such as nitrogen for example, through it. If a co-current gas flow is desired, gas is provided through port 17 of feeder tube 6 and exits heating chamber 4 through process vent 20. If counter flow is desired, the direction of flow can be reversed. A counter flow of non-oxidizing gas in discharge chute 22 may also be provided. Furthermore, a non-oxidizing atmosphere may be provided in heating chamber 4 by maintaining a positive pressure of gas through heating chamber 4 using gas passageways 16 into heating chamber 4. In addition, a desired atmosphere may be provided in feed mechanism 41 using inlet 18 in hopper 12. Similarly, a desired atmosphere in entrance or drive section 47 may be provided through drive area gas port 19. Thus, multiple alternate atmospheres and alternate current flows may be employed in furnace 1.

Overhung graphite rotary tube furnace 1 may be used to process various types of feed material, including particulate material. For example, furnace 1 may be used to process silicon particulate material, with the silicon particulate material melting inside quartz lined process tube 2 and exiting through discharge assembly 21 as a liquid. Furnace 1 is generally suitable for the treatment of particulate material which melts at temperatures as high as 2600° C. The preferred temperature range of furnace 1 is from about 1200° C.-2200° C. For silicon processing the preferred temperature is about 1500° C. and the material may be fed directly into the heated and cantilevered section 37 of processing tube 2 to melt.

The present invention contemplates that many changes and modifications may be made. Therefore, while the presently-preferred form of the improved furnace has been shown and described, and a number of alternatives discussed, persons skilled in this art will readily appreciate that various additional changes and modifications may be made without departing from the spirit of the invention, as defined and differentiated by the following claims.

What is claimed is:

1. A rotary tube furnace comprising:

an insulated heating chamber;

said insulated heating chamber having a product discharge outlet and a process tube inlet;

a heating element operatively arranged to selectively heat said heating chamber;

a generally horizontally extending process tube supported for rotation relative to said heating chamber;

said process tube having a first portion generally arranged outside of said heating chamber and a cantilevered second portion extending from said first portion into said heating chamber and terminating in a discharge end within said heating chamber;

a feed mechanism configured and arranged to feed product into said process tube;

a bearing assembly operating between a support member and said first portion of said process tube and configured and arranged to support said process tube and transmit rotational torque to said process tube;

said bearing assembly comprising a drive motor, an inner collar extending around said first portion of said process tube, an outer cylindrical member connected to said collar and said drive motor, and a roller supporting said cylindrical member;

wherein said cylindrical member provides counterbalance to said cantilevered second portion of said process tube.

2. The rotary tube furnace set forth in claim 1, wherein said heating chamber comprises:

an outer shell;

a heat conductive muffle; and an insulation layer between said outer shell and said muffle.

3. The rotary tube furnace set forth in claim 1, wherein said heating chamber comprises a gas inlet and a gas outlet operatively arranged to maintain a selected gas atmosphere around said process tube in said heating chamber.

4. The rotary tube furnace set forth in claim 1, wherein said product discharge outlet comprises a discharge chute and a discharge heating element operatively arranged to selectively heat said discharge chute.

5. The rotary tube furnace set forth in claim 1, wherein said heating element is operatively arranged to selectively heat said heating chamber to at least 1200 degrees Celsius.

6. The rotary tube furnace set forth in claim 1, wherein said heating element is operatively arranged to selectively heat said heating chamber to about 2600 degrees Celsius.

7. The rotary tube furnace set forth in claim 1, wherein said heating element is a graphite resistance heating element.

8. The rotary tube furnace set forth in claim 1, wherein said heating element comprises induction coils and a graphite susceptor.

9. The rotary tube furnace set forth in claim 1, wherein said process tube is graphite or quartz.

10. The rotary tube furnace set forth in claim 1, wherein said process tube comprises a liner.

11. The rotary tube furnace set forth in claim 10, wherein said liner is quartz or ceramic.

12. The rotary tube furnace set forth in claim 1, wherein said process tube comprises two or more tube sections.

13. The rotary tube furnace set forth in claim 1, wherein said feed mechanism comprises a feeder communicating with a feeder tube that extends into said process tube.

14. The rotary tube furnace set forth in claim 13, wherein said feeder tube extends through said first portion of said process tube and terminates at a feed discharge end within said heating chamber.

15. The rotary tube furnace set forth in claim 14, and further comprising an insulating baffle between said feeder tube and said process tube.

16. The rotary tube furnace set forth in claim 13, wherein said feeder tube comprises a gas port operatively arranged to selectively provide a co-current or counter-current flow of gas through said process tube.

17. The rotary tube furnace set forth in claim 1, wherein said inner collar is flexible and further comprising a second supporting said cylindrical member.

18. The rotary tube furnace set forth in claim 1, wherein said process tube is inclined from said discharge end to said first portion.

19. A rotary tube furnace comprising:

a heating zone comprising an insulated heating chamber having a product discharge outlet and a process tube inlet;

a heating element operatively arranged to selectively heat said heating chamber;

a generally horizontally extending process tube supported for rotation relative to said heating chamber and having a feed entrance end and a product discharge end;

a feed mechanism configured and arranged to feed product into said process tube;

a bearing assembly operating between a support member and said process tube and configured and arranged to support said process tube and transmit rotational torque to said process tube;

said process tube and said bearing assembly configured and arranged such that said product discharge end is within said heating zone; and said bearing assembly comprising a drive motor, an inner collar extending around said first portion of said process tube, an outer cylindrical member connected to said collar and said drive motor, and a roller supporting said cylindrical member;

wherein said cylindrical member provides counterbalance to said cantilevered second portion of said process tube.

20. The rotary tube furnace set forth in claim 19, wherein said heating zone comprises:

an outer shell;

a heat conductive muffle; and an insulation layer between said outer shell and said muffle.

21. The rotary tube furnace set forth in claim 19, wherein said heating chamber comprises a gas inlet and a gas outlet operatively arranged to maintain a selected gas atmosphere around said process tube in said heating zone.

22. The rotary tube furnace set forth in claim 19, wherein said product discharge outlet comprises a discharge chute and a discharge heating element operatively arranged to selectively heat said discharge chute.

23. The rotary tube furnace set forth in claim 19, wherein said heating element is operatively arranged to selectively heat said heating zone to at least 1200 degrees Celsius.

24. The rotary tube furnace set forth in claim 19, wherein said heating element is operatively arranged to selectively heat said heating zone to about 2600 degrees Celsius.

25. The rotary tube furnace set forth in claim 19, wherein said heating element is a graphite resistance heating element.

26. The rotary tube furnace set forth in claim 19, wherein said heating element comprises induction coils and a graphite susceptor.

27. The rotary tube furnace set forth in claim 19, wherein said process tube is graphite.

28. The rotary tube furnace set forth in claim 19, wherein said process tube comprises a liner.

29. The rotary tube furnace set forth in claim 28, wherein said liner is quartz or ceramic.

30. The rotary tube furnace set forth in claim 19, wherein said process tube comprises two or more tube sections.

31. The rotary tube furnace set forth in claim 19, wherein said feed mechanism comprises a feeder communicating with a feeder tube that extends into said process tube.

32. The rotary tube furnace set forth in claim 31, wherein said feeder tube extends through said process tube feed entrance zone and terminates at a feed discharge end within said heating zone.

33. The rotary tube furnace set forth in claim 32, and further comprising an insulating baffle between said feeder tube and said process tube.

34. The rotary tube furnace set forth in claim 19, wherein said feed entrance end of said process tube comprises a gas port operatively arranged to selectively provide a co-current or counter-current flow of gas through said process tube.

35. The rotary tube furnace set forth in claim 19, wherein said inner collar is flexible and further comprising a second rollers supporting said cylindrical member.

36. The rotary tube furnace set forth in claim 19, wherein said process tube is inclined from said product discharge end to said feed entrance end.

37. A rotary tube furnace comprising:

an insulated heating chamber;

said insulated heating chamber having a product discharge outlet and a process tube inlet;

a heating element operatively arranged to selectively heat said heating chamber;

a generally horizontally extending process tube supported for rotation relative to said heating chamber and having a feed entrance end portion and a product discharge end portion;

a feed mechanism configured and arranged to feed product into said process tube;

said feed mechanism comprising a feeder communicating with a feeder tube that extends through said process tube inlet of said heating chamber;

said feeder tube comprising an end portion that extends into said heating chamber and terminates within said heating chamber;

said feeder tube having a thermal barrier at said end portion;

a bearing assembly operating between a support member and said process tube and configured and arranged to support said process tube and transmit rotational torque to said process tube; and said bearing assembly comprising a drive motor, an inner collar extending around said first portion of said process tube, an outer cylindrical member connected to said collar and said drive motor, and a roller supporting said cylindrical member;

wherein said cylindrical member provides counterbalance to said cantilevered second portion of said process tube.

38. The rotary tube furnace set forth in claim 37, and further comprising an insulating baffle between said feeder tube and said process tube.

39. The rotary tube furnace set forth in claim 37, wherein said product discharge end portion of said process tube is cantilevered.

* * * * *